United States Patent [19]

Zückler

[11] Patent Number: 4,617,434

[45] Date of Patent: Oct. 14, 1986

[54] CONTACT ARRANGEMENT FOR A VACUUM INTERRUPTER

[75] Inventor: Karl Zückler, Berlin, Fed. Rep. of Germany

[73] Assignee: Siemens Aktiengesellschaft, Munich and Berlin, Fed. Rep. of Germany

[21] Appl. No.: 646,435

[22] Filed: Aug. 30, 1984

[30] Foreign Application Priority Data

Sep. 2, 1983 [DE] Fed. Rep. of Germany ..... 3332092

[51] Int. Cl.[4] ..... H01H 33/66

[52] U.S. Cl. ..... 200/144 B

[58] Field of Search ..... 200/144 B

[56] References Cited

U.S. PATENT DOCUMENTS 4,196,327 4/1980 Kurosawa et al. ..... 200/144 B 4,243,859 1/1981 Peche ..... 200/144 B 4,453,054 6/1984 Peche et al. ..... 200/144 B

FOREIGN PATENT DOCUMENTS 0073925 7/1982 European Pat. Off. .

0082801 11/1982 European Pat. Off. .

*Primary Examiner*—Robert S. Macon

*Attorney, Agent, or Firm*—F. W. Powers; J. L. James

[57] ABSTRACT

An improved contact arrangement for a vacuum interrupter of the type including a conductive jacket adjacent a contact for producing a magnetic field of a predeterminal geometry. The pushrod supporting the contact is divided into two segments which are connected to the conductive jacket by flexible, conductive arms which separate the pushrod segments when the interrupter is closed.

12 Claims, 5 Drawing Figures

CONTACT ARRANGEMENT FOR A VACUUM INTERRUPTER

BACKGROUND OF THE INVENTION

1. Field of the Invention

The present invention relates to vacuum switching devices, and more particularly to an improved contact structure for such devices.

2. Description of the Prior Art

When the contacts of a vacuum interrupter are opened an arc arises between the two opposed contact electrodes, which is sustained by plasma emitted from the cathode of the two electrodes due to local overheating of areas of the electrodes. The emission of plasma can be increased by so much that the resulting deterioration of the vacuum inside the interrupter causes the interrupting capability of the contactor to be substantially impaired.

It is known that the localized overheating of areas of the contact electrodes can be reduced or eliminated by the targeted influence of magnetic fields. Radially directed magnetic fields effect a spiral or approximately circular form for the base of a contracted arc, while axially directed magnetic fields produce a diffused arc. Further, it is known to combine the effects of axial and radially directed magnetic fields, where the apportioning of the respective magnetic field components is carried out in such a way that the arc is diffuse up to relatively high currents and that upon the subsequent transformation of the diffuse arc into a contracted arc, the latter is driven by the radial magnetic field component along the surface of the contact electrode.

Apart from the use of external coils, i.e, of coils disposed outside of the vacuum interrupter chamber, and the use of the contact rod to generate a magnetic field which extends into the area of the contact electrodes, it is already known to design the contact making elements associated with the contact rods in such a fashion that a coil configuration is effected and a specially-configured magnetic field is set up. A number of different configurations of contact elements are known which produce magnetic fields of different directions and intensities. Since currents constantly flow through these coil configurations, the $I^2R$ heating produced in them contributes substantially to the total heat produced within the vacuum contactor. This added contribution can be responsible for more than half of the total heat generated in the vaccum contactor under continuous operating conditions. It stands to reason that an enlargement of the coil configuration, which determines the size of the contacts, should be made. However, this results in an increase in the volume and mass of the contact, leading to the enlargement of the drive mechanism for the contactor. It is furthermore known that, in order to keep the heat loss low, it is useful to divide the current flowing in the contact into several paths. However, the generated magnetic field is reduced in proportion to the division of the current into several paths. German Pat. No. 31 33 799 discloses a contact structure which is constructed in such a way that the continuous current of the contactor does not flow through the coil configuration of the contact; instead the coil configuration is achieved through slots in hollow disk-like elements. An internal face area of such a disk-like element lies opposite the appropriate face of the contact rod, separated by a gap. The gap is closed and contact is made by closing the contactor, the current flowing essentially through the contact rods. Upon opening the contactor, the current path between the face area of the contact shaft and the face of the hollow disk-like body is interrupted so that the total current flow runs over the surface area of the hollow disk-like body, which, with the help of the slots, leads to the generation of a magnetic field. While such a construction has advantages, it will be appreciated that it would be desirable to provide an easily manufactured, rugged arrangement for eliminating unnecessary $I^2R$ losses while still producing the desired field pattern.

It is therefore an object of the invention to provide a contact arrangement for disabling a coil of a vacuum interrupter at the contact when the interrupter is closed and allowing current to flow through the coil when the contactor is opened.

SUMMARY OF THE INVENTION

In accordance with one aspect of the invention the foregoing object is achieved by providing a contact rod which is divided into two serial segments. The connection of the surrounding contact shell with the contact rod segments is made through flexible conductive arms connected between the rod segments and the surrounding shell. The flexible arms hold the two rod segments appart so that in a relaxed condition the only current path between them is through the arms and the shell. When the interrupter is closed the rod segments are forced together, effectively short circuiting the arms and shell.

BRIEF DESCRIPTION OF THE DRAWINGS

While the specification concludes with claims particularly pointing out and distinctly claiming the subject matter which is regarded as the invention, it is believed that the invention will be better understood from the following description of the preferred embodiment taken in conjunction with the accompanying drawings in which:

DESCRIPTION OF A PREFERRED EMBODIMENT

Figure 1:
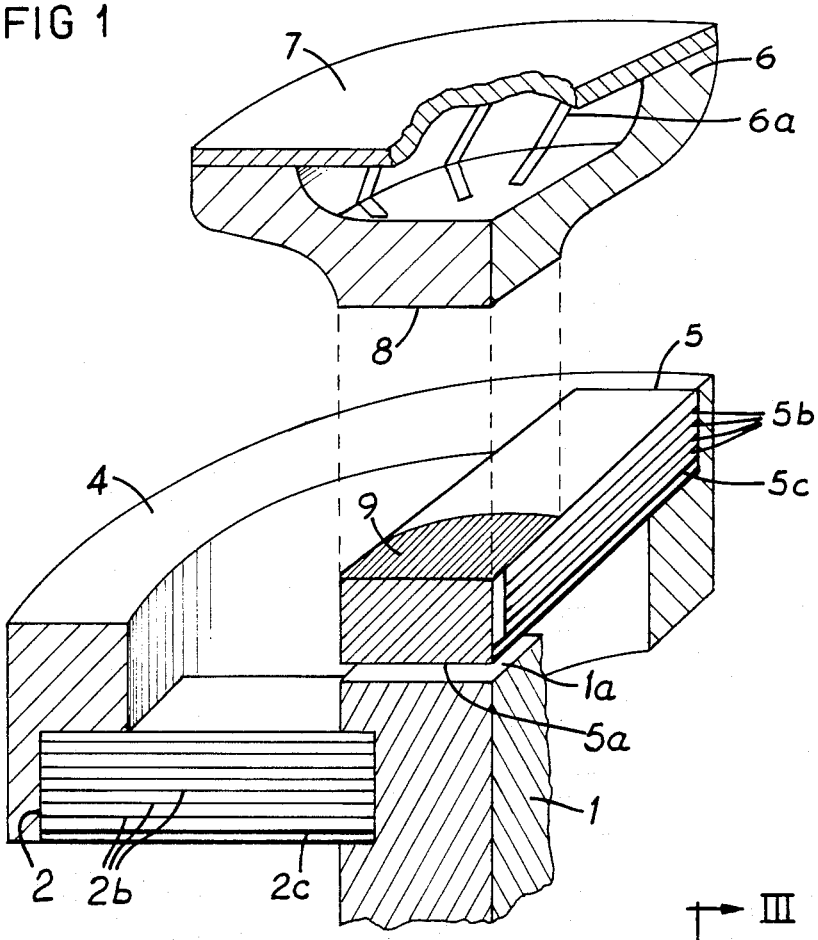
FIG. 1 is a cutaway quarter-section, perspective view of one of two cooperating contact assemblies of a vacuum switch utilizing principles of the present invention.

Referring now to FIG. 1 there is shown a contact arrangement including a contact rod 1 comprising an endside contact surface 1*a*. A ring-shaped jacket 4, which is connected to contact rod 1 by two arms 2, 3 which are composed is of a conductive material.

Figure 2:
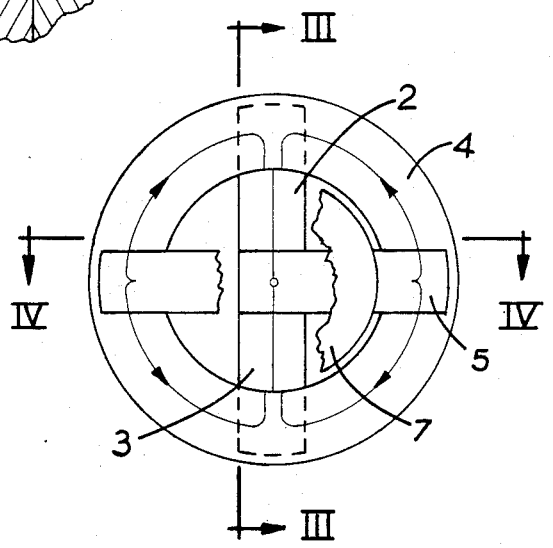
FIG. 2 is a cutaway top view, schematic illustration showing current flow in such a structure during contact opening.
Figure 3:
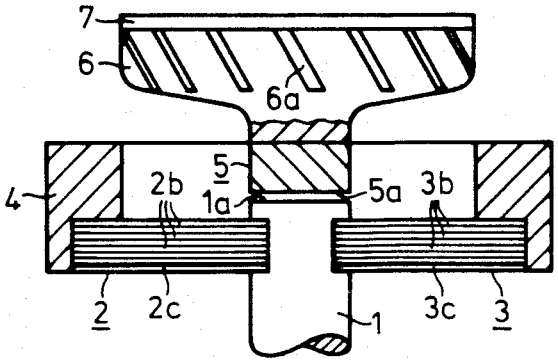
FIG. 3 is a sectional view along III—III of FIG. 2 showing a cross section of arm 5.
Figure 4:
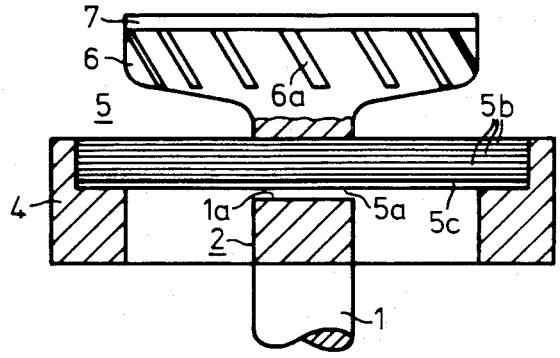
FIG. 4 is a sectional view along IV—IV of FIG. 2 showing a cross section of arm 2.
Figure 5:
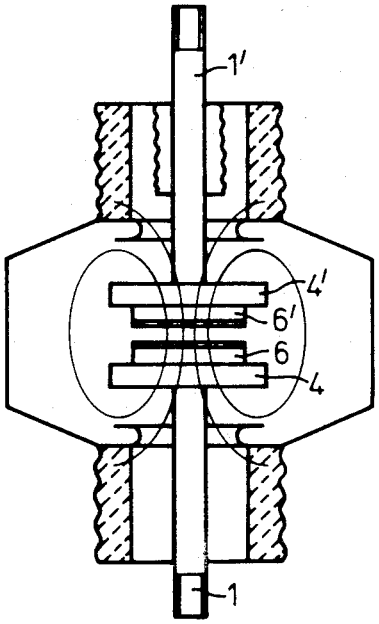
FIG. 5 shows, in a pictorial representation of a partial section of the Circuit Interrupter, the opening of the two contact bodies and the generated magnetic field during opening until contact arcing ceases.

By referring to FIG. 2 it will be apparent that the structure of the apparatus is symmetrical and that another arm 3 connects rod 1 with a point on jacket 4 diametrically opposite the connection point of arm 2.

Further is FIG. 2 there is shown another arm 5 which couples diametrically opposed points on jacket 4.

Returning to FIG. 1, arm 5 serves to carry and locate contact body 6 in axial alignment with contact rod 1. As indicated by dotted lines contact 6 is shown at a distance above jacket 4 so as to give a complete view of jacket 4 and arm 5. A central portion 8 is provided on contact 6 for securing contact 6 to arm 5. A hatched area 9 is shown on arm 5 to indicate where arm 5 and contact 6 are secured to each other.

Contact 6 comprises a cup-shaped body which is closed on top by lid electrode 7, and is provided with slots 6*a*, which in cooperation with similar but opposite inclined slots, in a mating contact (not shown), generate a magnetic field with radial components in the second contact. Arms 2, 3, and 5 are made of by parallel lying copper strips illustrated at 2*b*, 5*b* in FIG. 1, and a base for the copper strips is formed by a spring 2*c*, 5*c* made from an alloy containing primarily copper with 0.4 to 0.8 percent chromium spring 2*c*, 5*c*. Another spring is contained in arm 3 (not shown in FIG. 1), respectively.

In the position of the described components shown in FIG. 1 there is a distance between a contact area 1*a* of contact rod 1 and a corresponding contact area 5*a* which is centrally located on arm 5 opposite contact area 1*a*. Thus, current has to pass from contact rod 1 through arms 2 and 3, jacket 4 and arm 5 before entering into contact 6. The magnetic fields created by currents flowing in these arms and jacket and the effects produced thereby are well known to those skilled in the art, as evidenced by U.S. Pat. No. 4,196,327-Kurosawa et al. There is a shortened or direct path of current from contact rod 1 to contact 6 as soon as contact areas 1*a* and 5*a* are brought into engagement with each other by applying to contact 6 an axial force of sufficient strength.

The invention is independent of the design of the contacts themselves and is relatively easy to produce from a manufacturing point of view, and assures functional safety. The optimal bending property of the contact arrangement results from considerations relating to the distance between contact areas and face area of the contact rod, and the acting forces of the driving device of the vacuum interrupter can be altered to a wide extent though the geometry of the arms. In view of the fact that bending of a rod, fixed at one end, depends on the third power of the rod dimension in the bending direction, it can be seen as advantageous to vary dimensions of the arms in the direction of the contact bolts to tailor the total of the contact arrangement of the desired properties of elasticity. In particular, it is considered advantageous that the dimension of the arms in the direction of the axis of the contact rod is less than that measured in the direction perpendicular thereto, and to the longitudinal axis of the arms.

On such a design of a contact, with diametrical arms for the connection of the contact jacket to the contact rod, there is a current flow in each section area of the contact jacket lying between the connecting points of the arms which is only one-quarter of the total currennt flow. If a diminishing of the (axial) magnetic field connected therewith is not desired, another design of contact maker could be selected in which only one arm for the connection of the contact rod with the contact jacket is provided, reaching from the contact jacket over the face area of the contact rod. In this way in each section area of the current ring there flows half of the total current. In both designs, an essentially axially directed field is generated.

An additional, radial component of the magnetic field can be achieved by providing slots into the contact jacket which are slanted towards its center. The contact jacket has the function of generating an essentially axially directed magnetic field. This can be achieved with many different variations, in particular with a current dividing, so-called multi-pole arrangement. The most simple realization of radial field components can be achieved when the edge of the contact has slanted slots which are arranged in opposite directions in the two opposing contacts. In order to reduce harmful effects of eddy currents on the operation of the vacuum switch tube, the slots can extend into the bottom of the contact. Other variations of such pot-like contacts could be used in other contact structures, including structures comprising a contact covered with a lid electrode made of contact material.

For the prevention and/or reduction of eddy currents areas of reduced cross section are provided in the the lid electrode 7. Reduction of the cross-section total can be provided in the known manner, by slots. Another possible reduction of the cross-section can be achieved by drilling holes parallel to the contactor axis, which assures a more adequate material strength of the arrangement with the same effect upon eddy currents. Independent of the mode of generation of the radially directed magnetic field in the pot-like contact it is considered advantageous that the I.D. of the contact jacket 4 is at least as large as the O.D. of the lid electrode 7. In this manner it will be assured that the total area of the lid electrode will be permeated by the predominantly axially-directed magnetic field which is generated in the contact shell. Otherwise, the dimensioning of the springy arms; the distance between the face areas of the contact rod segments and the contact area of one of the arms; as well as the adjusting of the driving means for the vacuum contactor to these criteria should be done in such a way that the confronting ends of the contact rod segments are well separated, with the current now transferred onto the contact jacket, when the contactors are separated.

To obtain a sufficient axial field component, at this moment of separation of the contacts, the time-constant being in the coil arrangement formed by the contact shell must be as small as possible, since a reduction of the inductance is ordinarily achieved by modifying the inside and outside diameter of the contacts. Since these dimensions are, however, determined by the other requirements of the vacuum interrupter, another way of reducing the time constant is by increasing the resistance value of the contact shell. This is accomplished by decreasing the cross-sectional area of the contact shell; it is, however, limited because of considerations of strength of materials and the heat loading limit of the contact material.

This could be mitigated by a judicious selection of materials, such as replacing copper by a resistance material, etc. To avoid damage to the contact area and the confronting ends of the contact rod segments by arcing, it may be desirable to cover these areas with contact material; in this manner welding together of the surfaces can be avoided.

As will be evident from the foregoing description, certain aspects of the invention are not limited to the particular details of the examples illustrated, and it is therefore contemplated that other modifications or applications will occur to those skilled in the art. It is accordingly intended that the claims shall cover all such modifications and applications as do not depart from the true spirit and script of the invention.

What is claimed as new and desired to be secured by Letters Patent of the United States is:

1. A contact arrangement for a vacuum switch having an open and a closed position with two contact assemblies fixed to two contact rods moveable relative to one another to effect said open and closed positions, comprising:

at least one support arm as part of each said contact assembly, solidly connected on one end to its respective contact rod;

a contact jacket as part of each said contact assembly solidly connected to another end of its respective, at least one, support arm, each said contact jacket partially surrounding an end of each respective contact rod;

a contact arm as part of each said contact assembly solidly connected at one end to its respective contact jacket, each said contact arm having an inner contact surface for electrically connecting with its respective contact rod end when in the closed position;

a contact body as part of each said contact assembly solidly connecting on an outer surface to each respective contact arm, each said contact body electrically connecting with the other contact body when said contact arrangement is in the closed position; and each said support arm and each said contact arm having a high electrical conductivity and a high mechanical elasticity; said high mechanical elasticities of said support arms and said contact arms act as spring tensions during a change from the closed position to the open position causing each said contact rod end to separate from its respective contact arm, inner contact surface while the spring tensions keep the contact bodies together until subsequently the contact bodies move to the open position.

2. A contact arrangement in accordance with claim 1, wherein the extension of the arms in an axial direction of the contact rod is smaller than an extension measured in the perpendicular direction thereof, and smaller than measured in the direction perpendicular to a longitudinal axis of the arms.

3. A contact arrangement in accordance with claim 2, wherein the arms are made of several plates layered one over the other, of a material with high electrical conductivity and with at least one spring element tightly connected thereto.

4. A contact arrangement in accordance with claim 3, wherein each said contact jacket is of a circular shape and the connection of each respective contact jacket with its respective contact rod is made by two diametrically aligned support arms.

5. A contact arrangement in accordance with claim 4, wherein each said contact arm provided with the inner contact surface connects diametrically opposed areas of its respective contact jacket.

6. A contact arrangement in accordance with claim 1, wherein each said contact jacket is of a circular shape and is provided with slots which are oriented towards its central axis.

7. A contact arrangement in accordance with claim 1, wherein each said contact arm provided with the inner contact surface includes an opposite located area for receiving the central area of the bottom of a flat cup-shaped contact body.

8. A contact arrangement in accordance with claim 7, wherein the wall of contact body is provided with slots which are arranged slanting contrarily in two cooperating opposite located contact bodies.

9. A contact arrangement in accordance with claim 8, wherein said slots continue into the bottom of the contact body.

10. A contact arrangement in accordance with claim 1, wherein each said contact body is covered by a lid electrode made from contact material.

11. A contact arrangement in accordance with claim 10, wherein the lid electrode areas are distributed locally with a reduced total cross-sectional area.

12. A contact arrangement in accordance with claim 10, wherein said contact jacket is of a circular shape and the inside diameter of the contact jacket is at least equal to the outside diameter of the lid electrode.

* * * * *